United States Patent [19]

Falkenberg

[11] 4,337,287

[45] Jun. 29, 1982

[54] CORRUGATED TOOTHED WEB STRIP WITH PENETRATION STOPPERS FOR CONSTRUCTION ELEMENTS

[76] Inventor: Johan C. Falkenberg, Ed. Mercurio, H2, Cerrado de Calderon, Malaga, Spain

[21] Appl. No.: 165,657

[22] Filed: Jul. 3, 1980

[30] Foreign Application Priority Data

Nov. 2, 1979 [NO] Norway ..... 793542

[51] Int. Cl.[3] ..... B32B 3/28; B32B 7/08; E04B 2/32; E04C 2/32

[52] U.S. Cl. ..... 428/133; 52/650; 52/782; 52/800; 411/464; 411/473; 411/475; 428/132; 428/182; 428/183; 428/595; 428/597

[58] Field of Search ..... 428/132, 133, 182, 183, 428/595, 597; 52/782, 650, 800; 411/475, 473, 464

[56] References Cited

U.S. PATENT DOCUMENTS

| | | | |
|---|---|---|---|
| 948,913 | 2/1910 | Yetter | 411/475 |
| 3,563,843 | 2/1971 | Wagers et al. | 428/182 |
| 3,846,218 | 11/1974 | Wootten | 428/133 |
| 3,872,641 | 3/1975 | Falkenberg | 411/464 |
| 3,938,289 | 2/1976 | Falkenberg | 52/800 |
| 4,035,539 | 7/1977 | Luboshez | 428/182 |

*Primary Examiner*—Charles L. Bowers, Jr.

*Attorney, Agent, or Firm*—Ward, Lalos, Leeds, Keegan & Lett

[57] ABSTRACT

A web strip with penetration stoppers are placed transversely along one or both longitudinal edges. The stoppers are designed to abut the flange surface when the strip has been pressed into the desired depth to inhibit further penetration.

6 Claims, 14 Drawing Figures

CORRUGATED TOOTHED WEB STRIP WITH PENETRATION STOPPERS FOR CONSTRUCTION ELEMENTS

Figure 1:
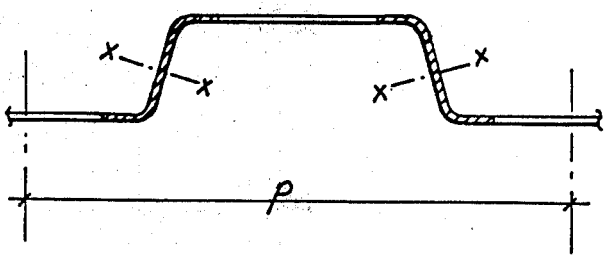

The present invention relates to web strips for construction elements of the kind described in U.S. Pat. Nos. 3,938,289 and 3,872,641 i.e. beam- or panel-shaped elements consisting of an upper and a lower flange held together in spaced relationship by one or several webs in the form of one or several corrugated sheet metal strips which along their edges are formed with teeth which are pressed into the respective flanges. Panel shaped elements can be made in the form of a closed box with bottom and top of plywood, particle board or similar mailable material and two or more longitudinal webs as well as end webs. Beams can be made with flanges of timber and one or several webs so that there is formed an I-beam or a tubular beam.

For such elements in which the upper and lower flanges are of the same material, one will normally use a web strip with the same tooth configuration along the two longitudinal edges. The pressing of the element is done to a controlled total thickness which equals the net height of the web (the distance between the tooth root-lines) plus the combined thickness of the two flanges. The stopping ability exhibited by the plate material when the straight root-line portion of the web abuts the flange surface is with such plate materials sufficient to counteract local variations in penetration resistance which otherwise could cause the teeth to penetrate unequally into the respective flanges.

However, it is frequently of interest to manufacture elements in the form of an open box in which the upper flange is a particle board or plywood and the lower flange is an open timber frame. This type element is, among other things, suited as a story divider in small houses since the open underside facilitates the placing of services such as electric wiring, water and soil-pipes. Such an element also gives good economy if one for reasons of fire-protection or appearance, desires a ceiling of a non-structural material, e.g. plasterboard or wooden paneling running crosswise to and nailed to the lower flanges of the elements.

In the manufacturing of such elements it has, however, proved difficult, with those forms of web strips which are described in the above patents, to obtain a correct embedment of the teeth. Timber frequently exhibits considerably less penetration resistance than other relevant plate materials, and for that part of the web strip which extends in the direction of the fibres, the resistance is particularly small. This causes the teeth on the timber side to not be stopped in their penetration but to continue their penetration past the rootline. Conversely, the teeth on the plate side may remain only partly embedded, so that the element does not become properly closed. This gives an unsatisfactory visual impression and also means that the joint between the web and the plate flange does not attain its full strength, which in a number of cases causes the element to be rejected.

This problem can to some extent be reduced by forming the web strip with longer and broader teeth on the timber side than on the plate side, but the possibilities here are limited. Furthermore, in producing beams with timber flanges it has been observed that the problem of unequal penetration may arise as a consequence of differences in material quality, direction of growth-rings, etc. in the two flanges.

It has been realized, therefore, that the problem of unequal penetration best can be solved, not by increasing the penetration resistance of the tooth, but by increasing the stopping ability of the root-line portion.

With this realization as a starting point, the present invention consists in providing the web strip with penetration stoppers along one or both longitudinal edges. Such a stopper comprises, in principle, a flat or edge portion disposed to extend transversely of the longitudinal edge of the web and designed to abut the flange surface when the strip has been pressed into the flange to the desired depth to thereby inhibit further penetration.

A thin plate, placed on edge and pressed into timber, meets little resistance if placed in the fibre direction, but placed across the grain, the penetration resistance increases many fold. The main principle for such stoppers, as will be described below, whether in the form of a flat plate or a cutting edge, is that the same must be disposed to shear across fibers when they penetrate into the timber flange. This provides an abrupt increase in the penetration resistance and thereby a stopping power sufficient to compensate for the difference in hardness between the two flanges.

Figure 2:
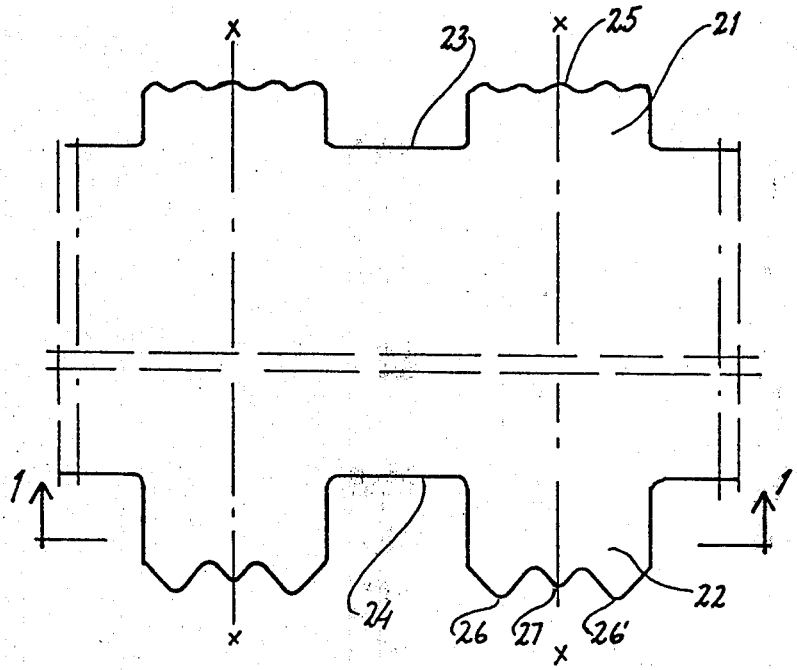
Figure 3:
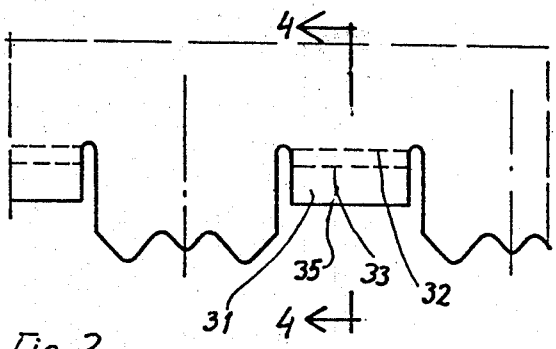
Figure 4:
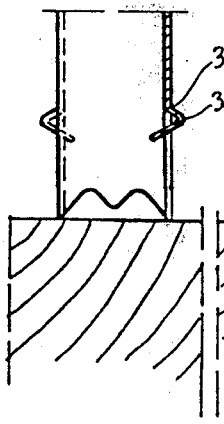
Figure 5:
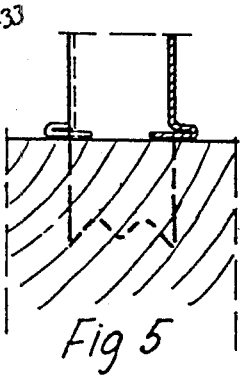
Figure 6:
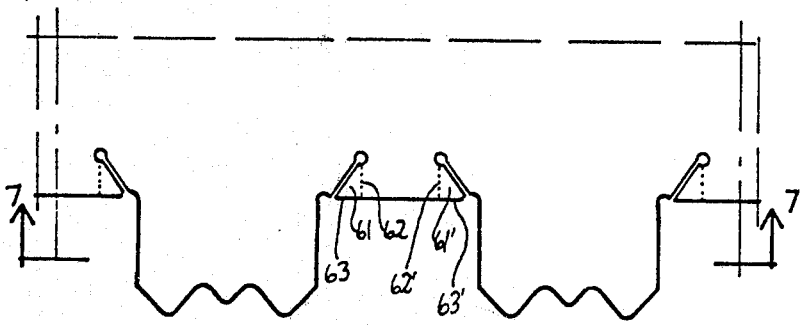
Figure 7:
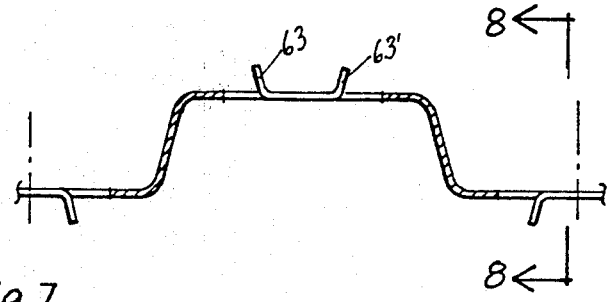
Figure 8:
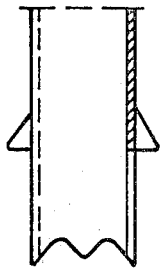
Figure 9:
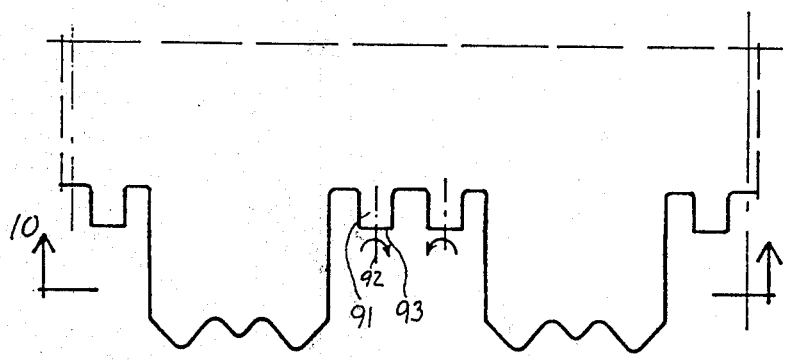
Figure 10:
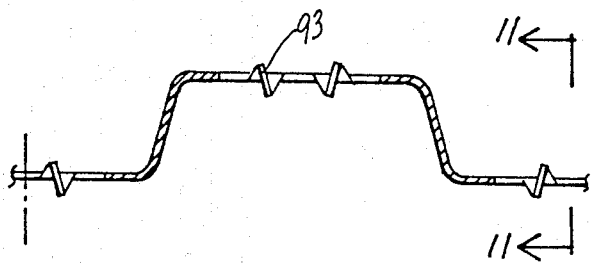
Figure 11:
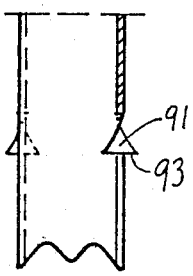

A number of embodiments of the invention will in the following be described with reference to the drawings, in which FIG. 1 shows a typical corrugation profile for a web strip, FIG. 2 shows a portion of a stamped, but not yet profiled web strip, without penetration stoppers, FIG. 3 shows a portion of a stamped, but not yet profiled web strip, with penetration stoppers on the timber side, FIGS. 4 and 5 show, in section taken along line 4—4 in FIG. 3, the edge portion of the finished web strip, respectively before and after penetration, FIGS. 6, 7 and 8 show respectively, a stamped blank, section 7—7 in FIG. 6 and section 8—8 in FIG. 7, of a web strip with an alternative penetration stopper, FIGS. 9–11 show, in a way corresponding to FIGS. 6–8, an embodiment with a further type of penetration stopper, as a stamped blank, in section 10—10 and in section 11—11, respectively.

Figure 12:
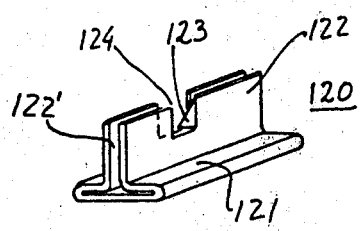
Figure 13:
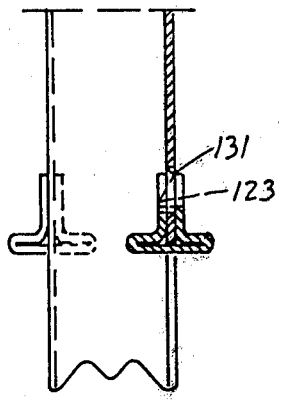
Figure 14:
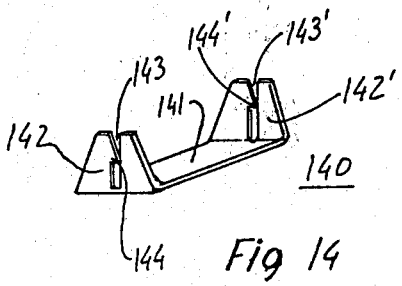

FIG. 12 shows, in perspective view, a penetration stopper in the form of a loose stopping foot to be mounted on the web strip shown in FIGS. 1 and 2, and FIG. 13 shows the strip with the clipped-on foot in a vertical section analogous to sections 4, 5, 8 and 11, and FIG. 14 shows an alternative form for a loose stopping foot.

On FIG. 1 is shown a typical corrugation profile for a web strip the tooth configuration of which is shown on FIG. 2. The profile in FIG. 1 is shown as a section 1—1 after the profiling of the blank shown on FIG. 2. The web strip has a trapezoidal corrugation profile with pitch length p. The tooth axes are denoted x—x, so that every corrugation period contains two teeth at either edge of the strip. The shorter teeth 21 with the small-wave shaped edge 25 are designed to penetrate into a plate material, while the longer teeth 22, with the larger teeth tips 26, 26' and 27, are designed for penetration into wood. The root lines are denoted 23 and 24, respectively, If now a web strip with the shape shown on FIGS. 1 and 2 is being pressed simultaneously into an upper flange of hard particle board and a lower flange of wood, the situation will, in many cases, be that the tooth on the plate side will be only partly embedded when the tooth on the wood side is completely embedded, that is when the tooth root line edge 24 abuts against the timber flange. This edge portion 24 extends mainly along the grain of the timber flange, since it is by shearing across the grain that the major part of the penetration resistance arises. Further pressing of the element will therefore only lead to a further penetration of the tooth with its root portion on the timber side while the tooth on the plate side will remain only partly embedded.

FIG. 3 shows how it is possible to obtain an increase in the stopping power of the root portion by forming a 'stopping foot' in the form of a lip or tongue 31 which is pre-folded along lines 32 and 33 as shown in vertical section 4—4 through the finished strip. As the tooth penetrates into the wooden flange, the tongue's leading edge 35 will abut the flange, whereafter the tongue folds further along the lines 32 and 33 until it forms a flat foot abutting against the wood flange such as shown on FIG. 5. In order for this foot to penetrate into the wood, a shearing across grain as well as a compression of the material beneath the foot must take place, and the increase in the stopping force associated therewith has proved to be sufficient to secure correct penetration with those materials which are of relevance, i.e. constructional plywood, particle board and spruce and pine timber.

A stopping foot in the form of a folded tongue may also be made with three fold lines instead of two, so that there will be three layers of sheet metal instead of two layers in the finished flat foot. By thus making the foot stiffer, it may be made wider in the direction transversely to the strip length, and thereby more efficient.

Furthermore it is clear that the stopping foot can have the shape of a tongue which only is folded along the root line 32, or the tongue may be divided into several parts which fold alternatively to the one and to the other side of the strip.

FIGS. 6–8 show a penetration stopper in the form of stamped triangular portions 61, 61' which are folded along lines 62 and 62' so that the edge portions 63, 63' are placed transversely to the strip length direction and thereby cause fiber shearing upon penetration. The increase in stopping power thus obtained will normally be sufficient to compensate for the difference in hardness between two wooden flanges and thereby secure correct penetration. This embodiment is therefore well suited for web strips for beams with timber flanges.

FIGS. 9–11 shows an alternative form for the penetration stopper, also based on the above described principle. Here the fibre-shearing edge portions are formed by tongue-shaped portions 91 which are twisted around their axis 92 in such a way that the leading edge 93 of the tongue is placed transversally to the strip length direction. This causes an abrupt increase in the penetration resistance of the strip, thereby giving the root portion the necessary stopping power to ensure correct penetration.

Rather than forming the penetration stopper integrally with the web strip as shown in the above examples, it may be formed as a separate element to be mounted on the root portion of the strip. Such an embodiment is shown in FIGS. 12 and 13 in the form of a stopping foot made from a plate 120 folded in such a way that there is formed a flat foot 121 and two vertical walls 122, 122' by which the foot is clipped on to the edge portion of the web. In order to further secure the attachment, the foot is formed with a lock in the form of a triangular lip 123 stamped in the wall 122 and bent inwards at a right angle to the latter, while there at the edge of the opposing wall 122' is cut an opening 124 which gives room for the lip 123. The lip 123 engages in a hole 131 (FIG. 13) formed in the web strip, so that the foot is prevented from sliding off the strip. Such a stopper, which is manufactured separately, may be made from a thicker material than the web strip itself and may thus be made wider and more efficient than stoppers formed integral with the strip.

FIG. 14 shows an alternative embodiment of a separate stopping foot which is somewhat simpler to produce than the one shown on FIG. 12. The foot of FIG. 14 consists of a plate 140 which has been folded in such a way that there is formed two vertical end walls 142, 142' with an intermediate flat foot portion 141. The walls 142, 142' are formed with slots 143, 143' so that the foot 140 may be clipped on to the root portion of the web strip between the teeth, whereby the triangular points 144, 144' at one edge of the slots snap into holes in the web strip so that the foot is locked thereto.

Although the various embodiments of the invention have been described with reference to a web strip with a trapezoidal corrugation profile, it is obvious that other profiles, such as shown by way of examples in the above mentioned patents, and provided with stoppers, are encompassed by the invention, the scope of which is limited only by the patent claims.

Furthermore it is obvious that the invention includes combinations of the various embodiments, e.g. web strips with one type stoppers along one longitudinal edge and a different type stoppers along the other edge, or a combination of two different stoppers along one and the same longitudinal edge.

I claim:

1. A corrugated sheet metal web strip for use in forming a construction element comprising a pair of flanges of nailable material joined together in spaced relationship by a said web strip that extends edgewise therebetween, said strip being provided with a series of flange embedding teeth spaced longitudinally apart along each of the longitudinally extending edges of the strip, said strip being provided with a plurality of penetration stoppers disposed respectively between the teeth on at least one longitudinally extending edge of the strip, said stoppers each comprising an element disposed to extend transversely of the strip edge for abutting the respective flange when the adjacent teeth have become embedded to the intended depth in the flange to thereby inhibit further penetration by the web strip into the flange.

2. A corrugated sheet metal strip as set forth in claim 1, wherein said stoppers each have the form of a tongue which is capable of being folded along at least one line that extends parallel to the longitudinal edge of the strip whereby the tongue is adapted to form a foot which flatly abuts the flange surface when the strip is embedded in the flange.

3. A corrugated sheet metal strip as set forth in claim 2, wherein said tongue is pre-folded in one direction along its root line and in the opposite direction along an outwardly located and parallel line so that upon penetration of the teeth into the flange the pre-folded tongue contacts the flange surface and is folded further along the two lines to a total of about 90° about the root line and about 180° about the other line to thereby present a foot which flatly abuts the flange surface between said surface and the edge of the web.

4. A corrugated sheet metal strip as set forth in claim 1, wherein at least a portion of the penetration stoppers have the form of triangular portions which may be twisted out of the plane of the strip to present edge portions which extend transversely to the edge of the strip.

5. A corrugated sheet metal strip as set forth in claim 1, wherein at least a portion of the penetration stoppers have the form of tongue shaped portions which may be twisted out of the plane of the strip to present edge portions which extend transversely to the edge of the strip.

6. A corrugated sheet metal strip as set forth in claim 1, wherein at least a portion of the penetration stoppers comprise separate elements mounted on the web strip between the teeth, said separate elements each comprising a flat, flange abutting foot portions disposed along the edge of the strip.

* * * * *